US006034704A

United States Patent [19]

Stewart et al.

[11] Patent Number: 6,034,704

[45] Date of Patent: Mar. 7, 2000

[54] PRINT STABILIZATION PROCESS AND APPARATUS

[76] Inventors: Gary E. Stewart, 2122 Shangri La Rd., Phoenix, Ariz. 85029; Gregory R. Williamson, 14201 N. 11th St., Phoenix, Ariz. 85022

[21] Appl. No.: 09/062,886

[22] Filed: Apr. 20, 1998

[51] Int. Cl.[7] ..... B41J 2/32

[52] U.S. Cl. ..... 347/171; 347/221; 347/212; 503/227

[58] Field of Search ..... 347/221, 171, 347/212; 503/227

[56] References Cited

U.S. PATENT DOCUMENTS

Re. 33,525 1/1991 Kohashi ..... 347/212

5,440,329 8/1995 Meggitt et al. ..... 347/212

5,512,930 4/1996 Brandt et al. ..... 347/212

5,546,114 8/1996 Tait et al. ..... 347/212

*Primary Examiner*—Huan Tran

*Attorney, Agent, or Firm*—Tod R. Nissle, P.C.

[57] ABSTRACT

A thermally activated substrate prolongs the life of thermally activated images formed on the substrate by a headed imprinting head. The substrate also prolongs the life of the imprinting head. The substrate includes a substrate sheet; a coating of a thermally activated material; and, a transparent coating of a thermally resistant opaque or translucent polymer composition.

4 Claims, 1 Drawing Sheet

PRINT STABILIZATION PROCESS AND APPARATUS

CROSS-REFERENCE TO RELATED APPLICATIONS

None.

STATEMENT REGARDING FEDERALLY SPONSORED RESEARCH OR DEVELOPMENT

None.

REFERENCE TO "MICROFICHE APPENDIX" (see 37 CFR 1.96)

None.

BACKGROUND OF THE INVENTION

1. Field of the Invention

This invention relates to thermally activated substrates.

More particularly, the invention relates to a thermally activated substrate which prolongs the life of thermally activated images formed on the substrate by a heated imprinting head and which prolongs the operational life of the imprinting head.

In another respect, the invention relates to a thermally activated substrate that reduces by about 25% the cost of providing a heat resistant, solvent resistant, sun resistant substrate on which alphanumeric characters or other images are formed by heated imprinting heads.

2. Description of the Related Art including Information Disclosed Under 37 CFR 1.97 and 1.98.

Thermally activated substrates, while well known in the art, produce images which have limited clarity, which fade with time, and which are susceptible to being damaged by heat, solvents, soaps, alcohols, sun screen compositions, and/or other chemical components. For example, direct thermal paper has long been utilized in facsimile machines. Documents produced by facsimile machines using direct thermal paper fade with time and are susceptible to damage by sunlight, solvents and other chemicals. Facsimile documents are fragile. Processes for protecting a facsimile document are impractical or expensive. In particular, applying a conventional 0.001 inch thick sheet of plastic to facsimile paper has long been dismissed out-of-hand because of the expense involved, because the plastic melts or becomes tacky and sticks to the thermal imprinting head, or because the plastic functions as a heat insulator which prevents the thermally sensitive coating on the fax paper from being properly activated by heat from the thermal printing head.

Another well known wax thermal transfer product is significantly more resistant to extraneous elements than the facsimile documents discussed above. During use of the wax thermal transfer product, wax is thermally transferred from a ribbon to paper, in a manner similar to that in which carbon from carbon paper interleaved between an original form sheet and a form copy positioned directly beneath the original form sheet is transferred by pressure from the carbon paper to the form copy when information is typed on the original form sheet. The pressure generated when a type head strikes the original form sheet causes carbon from the carbon paper to adhere to the form copy. Similarly, during use of the wax thermal transfer product, a heated imprinting head strikes the ribbon and presses it against a substrate. Pressure and heat generated by the imprinting head cause the wax to adhere to the substrate. While the resulting wax image is more durable than a comparable thermal image formed on facsimile paper, the wax image is not necessarily any sharper than the facsimile paper image. In addition, the wax thermal transfer product is relatively expensive and cumbersome. Once wax has been transferred from a ribbon to a piece of paper or other substrate, the ribbon must be destroyed because the information produced on the piece of paper is readily deduced simply by reading the ribbon.

Accordingly, it would be highly desirable to provide an improved process and apparatus for providing thermally activated imprinted substrates which produce images that are clearer, are resistant to solvents and heat and other extraneous elements, and are appreciably less expensive to produce than images produced with conventional thermal wax imprinting ribbons.

Therefore, it is a principal object of the invention to provide an improved apparatus and process for producing thermally activated images which appear clear, which are resistant to heat, sunlight, solvents, alcohols and other extraneous components, and which are less expensive and/or more durable than images produced with conventional wax ribbon or facsimile paper thermal processes.

Another object of the invention is to reduce the cost of producing durable thermal imprinted alphanumeric images or other imprinted images on a substrate.

BRIEF DESCRIPTION OF THE SEVERAL VIEWS OF THE DRAWING(S)

These and other further and more specific objects and advantages of the invention will be apparent to those skilled in the art from the following detailed description thereof, take in conjunction with the drawings, in which:

FIG. 1 illustrates a thermally resistant, thermally sensitive substrate constructed in accordance with the principles of the invention and being contacted by a thermal imprinting head; and, FIG. 2 illustrates the substrate and imprinting head of FIG. 1 after an image has been formed in the substrate and the imprinting head has been separated from the substrate.

SUMMARY OF THE INVENTION

Briefly, in accordance with our invention, we provide an improved process for producing thermally activated images on a substrate. The process includes the steps of providing a substrate sheet having a front side and a back side; coating the front side of the substrate sheet with a thermally activated material; providing a thermally resistant liquid polymer composition; applying a coating of the thermally resistant liquid polymer composition to the front side of the substrate over the thermally activated material; drying the polymer composition coating to form a thermally resistant coated substrate, the dried polymer composition coating comprising from 0.05% to 4.0% by weight of the coated substrate; and, contacting the dried polymer composition for a dwell time of less than about 0.1 second with a thermal imprinting head heated to a temperature in the range of 200 to 500 degrees F. to activate the thermally activated material intermediate the substrate sheet and the dried polymer composition coating; and, at the conclusion of the dwell time, separating the imprinting head from the dried polymer composition coating. The imprinting head separates from the dried polymer composition coating at the conclusion of the dwell time without the dried polymer composition coating sticking to the imprinting head.

In another embodiment of the invention, we provide an improved thermally activated, thermally resistant substrate for imprinting by a heated thermal imprinting head. The substrate includes a substrate sheet having a front side and a back side; a coating of a thermally activated material on the front side of the sheet; and, a coating of thermally resistant solidified polymer composition on the front side of the substrate over the thermally activated material. The polymer coating has a thickness of less than about 0.0003 inch, has a thermal resistance such that when the polymer coating contacts a thermal imprint head heated to a temperature in the range of 200 degrees F. to 500 degrees F. for a dwell of less than about 0.2 second, the polymer coating separates from the imprint head without sticking to the head.

In a further embodiment of the invention, we provide an improved thermally activated, thermally resistant substrate for imprinting by a heated thermal imprinting head. The substrate includes a substrate sheet having a front side and a back side; a coating of a thermally activated material on the front side of the sheet; and, a transparent coating of a thermally resistant opaque polymer composition on the front side of the substrate over the thermally activated material. The polymer coating has a thickness in the range of less than about 0.0003 inch; has a thermal resistance such that the transparent polymer coating contacts a thermal imprint head heated to a temperature in the range of 200 degrees F. to 500 degrees F. for a dwell of less than about 0.2 second and separates from the imprint head without sticking to the head; and, includes polymer particles.

In still another embodiment of the invention, we provide an improved process for producing thermally activated images on a substrate. The process includes the steps of providing a substrate sheet having a front side and a back side and a coating of a thermally activated material on the front side; providing a thermally resistant opaque liquid composition including at least one polymer; applying a coating of the thermally resistant liquid composition less than 0.0003 inch thick to the front side of the substrate on the coating of thermally activated material to form a coated substrate; drying the thermally resistant liquid composition coating to form a thermally resistant solidified polymer coating; and, contacting the solid polymer coating for a dwell time of less than about 0.1 second with a thermal imprinting head heated to a temperature in the range of 200 to 500 degrees F. to activate the thermally activated material intermediate the substrate sheet and the solidified polymer coating; and, at the conclusion of the dwell time separating the imprinting head from the solidified polymer coating, the imprinting head separating from the solidified polymer coating at the conclusion of the dwell time without the solidified polymer coating sticking to the imprinting head.

DETAILED DESCRIPTION OF THE INVENTION

Figure 1:
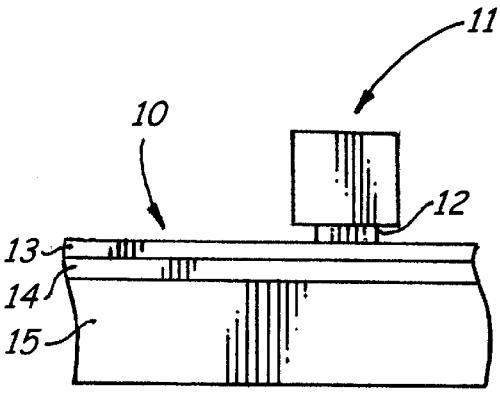
Figure 2:
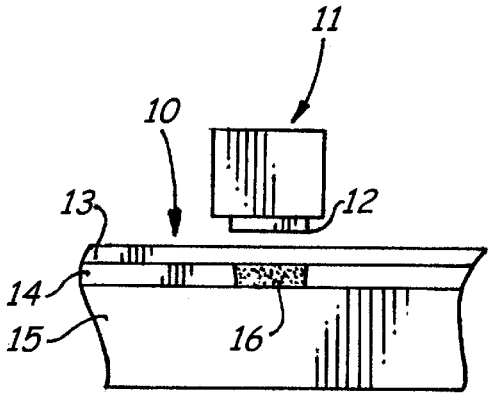

Turning now to the drawings, which depict the presently preferred embodiments of the invention for purposes of illustrating the invention and not by way of limitation of the scope of the invention, FIGS. 1 and 2 illustrate a thermally activated, thermally resistant substrate 10 including a sheet 15 of paper, plastic, or other desired material. Sheet 15 includes a front side and a back side. A coating 14 of thermally activated material is applied to the front side of sheet 15. A thermally resistant transparent coating 13 is applied to and over coating 14. When the upraised outwardly extending portion 12 of a heated imprint head 11 contacts coating 13, heat from head 11 activates a portion of coating 14 to form an image 16 which generally corresponds to portion 12. In FIG. 1, upraised portion has only just contacted coating 13 and heat from head 11 has not had time to thermally activate coating 14 to form image 16. In FIG. 2, heat from portion 12 of head 11 has activated a portion of coating 14 and caused image 16 to form, and, subsequent to the formation of image 16, head 11 has been separated from coating 13 such that portion 12 no longer contacts coating 13.

The selection and application of the material comprising coating 13 is critical in the practice of the invention. A great many polymer coatings will not function properly and will not, practically speaking, permit the invention to be practiced.

First, polymers are not, in comparison to metals and other materials, highly efficient transmitters of heat. Polymers commonly tend to insulate an object from heat. The coating 13 applied to coating 14 must be unusually thin. Coating 13 is less than about 0.0003 inch thick, and is preferably 0.0001 to 0.0002 inch thick. Coating 13 typically comprises about 0.05% to 4.0%, preferably 0.2 to 1.0%, of the total weight of substrate 10. Many, if not most or all, plastic films are too thick to be utilized in accordance with the invention.

Second, in the practice of the invention liquid polymer must be rolled or sprayed onto coating 14 to form coating 13. Attempting to bond a sheet of solid polymer is thought impractical due to the minimal thickness of coating 13. Polymer sheets which can be applied onto thermally sensitive coating 14 normally are too thick and, if the polymer sheet is thin enough (i.e., 0.0001 to 0.0003 inch), handling the sheet is difficult, if not totally impractical.

Third, the liquid polymer utilized to form layer 13 must, when the polymer solidifies to form layer 13, have an unusually high thermal resistance. A solidified polymer layer 13 has a high thermal resistance when it does not stick to an imprinting head that is heated to a temperature in the range of 200 degrees Fahrenheit to 500 degrees Fahrenheit and which has a dwell time of 0.2 seconds or less, preferably 0.1 seconds or less, during which the imprinting head contacts the solidified polymer layer 13. Thin solid polymer sheets often are prone to wrinkle and soften when exposed to such high temperature. The minimal thickness of layer 13 makes it difficult to identify a polymer material which will not soften and adhere to a thermal imprinting head under the conditions just described. The great majority of polymer materials simply apparently will not work. Applicant has discovered that certain high temperature polymer solutions will function in accordance with the invention and can be applied in liquid form in a thin coating and exhibit good resistance to softening and adhering to a thermal imprinting head contacting a solidified coating of the polymer solution:

One particular group of liquid polymer solutions utilized in the practice of the invention comprises opaque or translucent suspensions which consist of polymer particulates and other particulates in a liquid carrier, and which dry to form clear transparent coatings after being applied in accordance with the invention. Transparent, translucent, and opaque polymer solutions which do not contain solid particles can also, if desired, be utilized in accordance with the guidelines set forth herein.

Certain high temperature acrylic varnishes have been found to function in accordance with the invention, although not all high temperature acrylic varnishes will by any means function in accordance with the invention. Once experimentation is, however, undertaken with acrylic varnishes, a varnish which will function in accordance with the invention can be discovered without undue experimentation. By way of example, the following companies offer high temperature-resistance acrylic varnishes for sale: Quality Inks of 2327 East Jones Avenue, Phoenix, Ariz. 85040 (Telephone 268-4199); Fluid Ink of 5360 North Commerce Avenue, Moorpark, Calif. 93012 (Telephone (818) 499 1111); Arcar Graphics of 450 Wegner Drive West, Chicago, Ill. 60185.

The presently preferred acrylic varnish is DURAFILM™ High Resistant Overprint Varnish, Product No. AWX 28-93023. This acrylic varnish is normally utilized to overprint polyester, polypropylene and vinyl, but we discovered that the varnish bonds to thermally sensitive coatings which are applied to paper. The composition of such an acrylic varnish can vary, but can, by way of example and not limitation, include 0.5 to 4.0% anhydrous ammonia, 5% to 30% by weight alcohol(s), 20% to 60% by weight water, 1% to 10% by weight glycol ether; 15 to 20% by weight VOC's (volatile organic compounds), 35 to 45% acrylic or other solids; and, 3% to 7% by weight HAP. The DURAFILM™ acrylic varnish is opaque, and has a milky color prior to being applied. The milky color is believed to be produced because of undissolved acrylic or other particles which are suspended in and comprise in part the varnish. That such an opaque varnish suspension could be utilized to make a transparent coating is one of the unexpected results of the invention. Another unexpected result of the invention was that the thin coatings applied (i.e., less than about 0.0003 of an inch) could successfully resist the high temperatures found in thermal imprinting heads for dwell times in the range of 0.2 seconds or less. Still another unexpected result of the invention was that a particulate suspension could be utilized to produce a clear coating. Particulate normally blocks and scatters light. As used herein, a liquid polymer solution is opaque if the quantity of solution used to fill a clear glass bottle which has a one-half inch inner diameter is opaque. Such a bottle is opaque if the polymer solution in the bottle prevents a person from looking through the bottle (and the polymer solution in the bottle) from one side of the bottle to see an object on the other side of the bottle. By way of example, such a bottle filled with conventional white latex paint is opaque because it is not possible to look through the bottle. The paint filling the bottle is opaque. If, on the other hand, the bottle were filled with clean clear pure water, the bottle is not opaque because an object on one side of the bottle can be viewed by looking through the other side of the bottle and through water in the bottle at the object.

In another embodiment of the invention, UV9300 solventless UV silicon release liquid polymer sold by General Electric is utilized. The release polymer is mixed with a photoinitiator, also provided by General Electric, and a coating of the liquid release polymer—photoinitiator combination is rolled onto paper. The paper and coating are directed under an ultraviolet light to cure the release polymer. One disadvantage of the resulting dry silicon coating is that the coating does not readily accept writing or printing. The acrylic varnish coating described above does accept writing or imprinting. The UV silicon release liquid polymer is translucent, and, like the DURAFILM™ varnish, is not, prior to being applied in accordance with the invention, transparent.

Temperature resistant polymer liquids including polyester can be applied directly to the thermal transfer coating on a substrate. Polypropylene and other plastics are not, because of their lower melting temperatures, believed appropriate in the practice of the invention unless, possibly, there are suitable concentrations of polyester, acrylic, or other temperature resistant polymers or substances also present in the liquid coating applied directly to the thermally activated coating.

In a further embodiment of the invention, the heat resistant liquid polymer which is applied over the thermal coating on a piece of paper can include a product which blocks or absorbs ultraviolet light. One such UV product is FIRSTCURE ST-1 (™), a 2-phenoxyethoxyacrylate manufactured and sold by First Chemical Corporation of 1001 Industrial Road, Pascagoula, Miss. 39581. FIRSTCURE ST-1 is added to DURAFILM™ or another heat resistant polymer in a concentration of less than 0.01% by weight. Another UV product is FIRSTCURE NPAL or tris(N=nitroso, N-phenylhydroxylamine) aluminum salt, which is an inhibitor for olefinic resins and is added to such resins in a concentration in the range of 100 to 1000 parts per million. FIRSTCURE NPAL is insoluble in water and is also sold by First Chemical Corporation of Pascagoula, Miss.

There likely exist other high temperature resistant liquid polymer materials which are not acrylic varnishes, polyester liquids, or silicon liquids and which will function in accordance with the strictures of the invention. Such other polymer materials have not presently been identified.

Fourth, the liquid polymer used to form coating 13 must dry to form a transparent coating which preferably, but not necessarily, is less than about 0.0003 inch thick and which permits heat induced images 16 to be viewed through coating 13.

Fifth, the viscosity of the acrylic varnish must permit it to be readily rolled or sprayed onto coating 14 of substrate 10 to form a thin coating having a thickness of 0.0003 inch or less.

Sixth, coating 13 preferably, but not necessarily, must when dry have a sufficiently high "surface energy" to ink and permit alphanumeric characters and other characters or images or designs to be imprinted on coating 13 with ink.

Seventh, the solidified coating 13 must make image 16 appear to the human eye to be clearer and darker than the image 16 appears when coating 13 is not applied to coating 14. The acrylic varnishes and silicon release composition utilized in accordance with the invention provide an increase in clarity and darkness which can readily be ascertained by the human eye.

Eighth, the coating 13 is, as are the acrylic varnish and silicon coatings presently utilized in accordance with the invention, preferably resistant to attack by solvents, sun screen, sunlight, soaps, alcohols, and heat. Such resistance is critical in the practice of the invention because ordinary thermal transfer paper of the type found in facsimile machines is susceptible to attack by solvents, soaps, etc. The acrylic varnishes presently utilized in accordance with the invention are also resistant to a significantly wider range of common chemical components than documents prepared with the thermal wax transfer process earlier discussed.

Having described our invention in such terms as to enable those skilled in the art to understand and practice it, and having identified the presently preferred embodiments thereof,

We claim:

1. A process for producing thermally activated images on a substrate, comprising the steps of (a) providing a substrate sheet having a front side and a back side and a coating of a thermally activated material on said front side;

(b) providing a thermally resistant liquid composition including at least one polymer;

(d) applying a coating of said thermally resistant liquid composition to said front side of said substrate on said coating of thermally activated material to form a coated substrate;

(e) drying said thermally resistant liquid composition coating to form a thermally resistant solid polymer coating, said polymer coating when dry comprising from 0.05% to 4.0% by weight of said coated substrate;

(f) contacting said dried acrylic varnish coating for a dwell time of less than about 0.1 second with a thermal imprinting head heated to a temperature in the range of 200 to 500 degrees F. to activate said thermally activated material intermediate said substrate sheet and said polymer coating; and, (g) at the conclusion of said dwell time, separating said imprinting head from said polymer coating, said polymer coating separating from said imprinting head without sticking to said imprinting head.

2. A thermally activated, thermally resistant substrate for imprinting by a heated thermal imprinting head, said substrate including (a) a substrate sheet having a front side and a back side;

(b) a coating of a thermally activated material on said front side of said sheet;

(c) a coating of a thermally resistant polymer composition on said front side of said substrate over said thermally activated material, said polymer coating (i) having a thickness of less than about 0.0003 inch, (ii) having a thermal resistance such that when said polymer coating contacts a thermal imprint head heated to a temperature in the range of 200 degrees F. to 500 degrees F. for a dwell of less than about 0.2 second, said polymer separates from said imprint head without sticking to said head.

3. A thermally activated, thermally resistant substrate for imprinting by a heated thermal imprinting head, said substrate including (a) a substrate sheet having a front side and a back side;

(b) a coating of a thermally activated material on said front side of said sheet;

(c) a transparent coating of a thermally resistant opaque polymer composition on said front side of said substrate over said thermally activated material, said polymer coating (i) having a thickness of less than about 0.0003 inch, (ii) having a thermal resistance such that said transparent polymer coating contacts a thermal imprint head heated to a temperature in the range of 200 degrees F. to 500 degrees F. for a dwell of less than about 0.2 second and separates from said imprint head without sticking to said head, and (iii) including polymer particles.

4. A process for producing thermally activated images on a substrate, comprising the steps of (a) providing a substrate sheet having a front side and a back side and a coating on said front side of a thermally activated material;

(b) providing a thermally resistant opaque liquid composition including at least one polymer;

(d) applying a coating of said thermally resistant liquid composition less than 0.0003 inch thick to said front side of said substrate on said coating of thermally activated material to form a coated substrate;

(e) drying said thermally resistant liquid composition coating to form a thermally resistant solidified polymer coating;

(f) contacting said solid polymer coating for a dwell time of less than about 0.1 second with a thermal imprinting head heated to a temperature in the range of 200 to 500 degrees F. to activate said thermally activated material intermediate said substrate sheet and said solidified polymer coating; and, (g) at the conclusion of said dwell time separating said imprinting head from said solidified polymer coating, said imprinting head separating from said solidified polymer coating at the conclusion of said dwell time without said solidified polymer coating sticking to said imprinting head.

* * * * *